United States Patent [19]

Nakamura et al.

[11] Patent Number: 4,623,306

[45] Date of Patent: Nov. 18, 1986

[54] SCROLL COMPRESSOR WITH BEARING LUBRICATION MEANS

[75] Inventors: Toshiyuki Nakamura; Masahiro Sugihara; Tsutomu Inaba; Tadashi Kimura, all of Wakayama, Japan

[73] Assignee: Mitsubishi Denki Kabushiki Kaisha, Tokyo, Japan

[21] Appl. No.: 708,768

[22] Filed: Mar. 5, 1985

[30] Foreign Application Priority Data

Mar. 5, 1984 [JP] Japan ..... 59-42503

[51] Int. Cl.[4] ..... F04C 18/04; F04C 29/02

[52] U.S. Cl. ..... 418/55; 418/88; 418/94; 184/6.18

[58] Field of Search ..... 418/55, 88, 94; 184/6.16, 6.18; 417/368

[56] References Cited

U.S. PATENT DOCUMENTS 4,496,293 1/1985 Nakamura et al. ..... 418/55

FOREIGN PATENT DOCUMENTS 55-46081 3/1980 Japan ..... 418/55
57-151093 9/1982 Japan ..... 418/94
58-170871 10/1983 Japan ..... 418/94
59-32691 2/1984 Japan ..... 418/94

*Primary Examiner*—John J. Vrablik
*Attorney, Agent, or Firm*—Sughrue, Mion, Zinn, Macpeak & Seas

[57] ABSTRACT

A scroll compressor, such as may be used for a refrigeration compressor, having improved lubrication of bearing parts and sliding surfaces is disclosed. In accordance with the invention, the various components of the compressor, including both the orbiting and stationary scrolls and their driving components, are located in a housing, and lubrication passages are formed therein, such that an ample supply of lubricant is supplied to all bearing and sliding parts for all operating states of the compressor.

18 Claims, 10 Drawing Figures

SCROLL COMPRESSOR WITH BEARING LUBRICATION MEANS

BACKGROUND OF THE INVENTION

The present invention relates to a lubricating device for a scroll compressor which is used, for instance, in an air conditioning unit or a refrigerating unit for low temperature service.

The principles of a conventional scroll fluid machine will be described briefly.

FIGS. 1A to 1D show the fundamental components and illustrate the compression principles of a conventional scroll compressor. In these figures, reference numeral 1 designates a stationary scroll; 2, an orbiting scroll; 3, an intake chamber; 4, a discharge port; and 5, compression chambers. Further, reference character O designates the center of the stationary scroll 1.

The stationary scroll 1 and the orbiting scroll 2 have spiral arms or wraps 1*a* and 2*a*, respectively, which are similar in configuration to each other but which are wound in opposite directions. The configuration of the wraps 1*a* and 2*a* is that of an involute curve or arc, as is well known in the art.

The operation of the scroll compressor will be described. The stationary scroll 1 is held at rest, and the orbiting scroll 2 is combined with the stationary scroll 1 with a phase difference of 180° therebetween. The orbiting scroll 2 revolves around the center O of the stationary scroll 1 without itself rotating. That is, the orbiting scroll 2 is turned in a manner as illustrated in sequence in FIGS. 1A through 1D, which show the orbiting scroll at positions of 0°, 90°, 180° and 270°, respectively. When the orbiting scroll 2 is positioned as shown in FIG. 1A, the gas in the intake chamber 3 is enclosed and compression chambers 5 are formed by the wraps 1*a* and 2*a*. As the orbiting scroll 2 turns, the volume of each of the compression chambers 5 is progressively reduced to compress the gas therein. As a result, the gas in each compression chamber is discharged through the discharge port 4 provided at the center of the stationary scroll 1.

The basic principles of the scroll compressor are disclosed in U.S. Pat. No. 801,182 to Creux. Although the principles of the scroll compressor have long been understood, it was not put to practical use for many years for following reasons: As shown in FIGS. 1A through 1D and described above, the wraps of the stationary and orbiting scrolls are combined together and the orbiting scroll is moved in such a manner that it revolves around the center of the stationary scroll without itself rotating. So that this can be done smoothly and without significant leakage, the wraps must be machined with high precision. Because the compression chambers are intricate both in configuration and in construction, it is difficult to maintain the compression chambers closed. Furthermore, as the wraps wear, it becomes difficult to maintain the compression chambers tightly sealed.

In the 1970s, an improved technique of sealing the ends of the wraps was developed. Further improvements have also been made in the machining techniques used to manufacture the wraps. In 1982, mass-produced open scroll compressors were put on the market in Japan. The construction of these open scroll compressors is substantially the same as the scroll compressor disclosed, for instance, in U.S. Pat. No. 4,314,796. In the open scroll compressor, sliding parts such as bearings are lubricated mainly with a splash lubrication arrangement similar the type employed in a conventional reciprocation-type compressor.

Mass-produced closed scroll compressors were put on the market in Japan in 1983. In the lubricating arrangement of the closed scroll compressor, the lower end portion of a hollow vertical crankshaft used to drive the orbiting scroll is immersed in an oil pool, and compressed gas is applied to the oil pool so that lubricant from the pool is forced through the central hole of the hollow vertical crankshaft and then applied to sliding parts such as bearings.

The principles of the above-described method of utilizing the pressure of compressed gas to apply lubricant through the central hole in the crankshaft to sliding parts is disclosed in Japanese Laid-Open patent application No. 46081/1980 to Sugihara et al., especially in FIG. 20 thereof.

In another lubricating arrangement for a closed scroll compressor, as shown in FIG. 21 of the above-mentioned Japanese Laid-Open patent application No. 46081/1980, a lubricating path is formed in the crankshaft extending along an axis offset from the central (longitudinal) axis of the crankshaft. In this arrangement, the lubricant from the oil pool is sucked up by a centrifugal force caused by the rotation of the crankshaft. That is, the lubricating device is a self-actuated suction type. Further, it has been found by the present applicants that, in the case where a self-actuated suction type lubricating device is employed and a crankshaft driving motor is interposed between the orbiting scroll and the oil pool, the bearing supporting the upper end of the crankshaft must be positioned considerably high above the surface of the lubricant in the oil pool and must be restricted in size. This results in considerable resistance to the flow of lubricant, as a result of which it is difficult to sufficiently lubricate this bearing, and therefore the bearing is liable to wear quickly, sometimes even seize. These difficulties are exasperated by the fact also that the self-actuated suction-type lubricating device has only a small pumping capacity. These difficulties can be alleviated to some extent by increasing the diameter of the crankshaft so that the distance between the oil path formed in the crankshaft and the central axis of the crankshaft can be increased. However, such an increase of the diameter, and hence also of the weight, of the crankshaft causes other problems, including an increase in the required output power of the motor. Accordingly, the overall diameter of the compressor is excessively great.

SUMMARY OF THE INVENTION

An object of the invention is to provide a closed scroll compressor employing a self-actuated suction type lubricating arrangement in which an oil pool is provided below the orbiting scroll and an electric motor is arranged between the oil pool and the orbiting scroll so as to drive the orbiting scroll through a crankshaft, and in which a bearing supporting the upper end portion of the crankshaft and a coupling part or a sliding part through which the crankshaft is coupled to the orbiting scroll are sufficiently lubricated.

Another object of the invention is to increase the flow rate of lubricant supplied to the bearings and the sliding parts without significantly increasing the diameter of the crankshaft.

These as well as other objects of the invention are met by a scroll compressor comprising an orbiting scroll having a first spiral wrap on one side of a first base plate and an orbiting scroll shaft on the other side of the first base plate, a stationary scroll having a second spiral wrap on one side of a second base plate with the first and second wraps being combined together to form compression chambers therebetween, a main shaft for driving the orbiting scroll having a large-diameter part with an eccentric hole formed in an end face thereof to support the outer wall of the orbiting scroll shaft, a main bearing supporting the outer wall of the large-diameter part, a bearing frame supporting the main bearing and which is provided below the orbiting scroll and confronts the first base plate, an electric motor for driving the main shaft, and a housing having an oil pool at the bottom thereof. The housing accommodates the orbiting scroll and the stationary scroll above the bearing frame, and the motor is positioned below the bearing frame. A lower end portion of the main shaft is immersed in lubricant in the oil pool. A first lubricating hole is formed in the main shaft having one end opening in the oil pool and the other communicating with a first space formed between the bottom of the eccentric hole and the lower end of the orbiting scroll shaft. A first lubricating groove is formed in at least one of the outer wall of the orbiting scroll shaft and a supporting surface of the eccentric hole and extending vertically. The first lubricating groove has a lower end communicated with the first space. A second lubricating groove is formed in at least one of the outer wall of the large-diameter part and a supporting surface of the main bearing. The second lubricating groove extends vertically and has an upper end communicated with a second space formed between an upper end face of the main bearing and a lower surface of the first base plate. A second lubricating hole penetrates the large-diameter part to communicate the first and second lubricating grooves with each other. An oil path, which communicates with the second space, is formed between the orbiting scroll and the bearing frame. Oil return paths extend vertically in the bearing frame. Lubricant from the oil pool is circulated through the first lubricating hole, the first space, the first lubricating groove, the second lubricating hole, the second lubricating groove, the oil path, and the oil return paths by centrifugal force produced by rotation of the main shaft.

DESCRIPTION OF THE PREFERRED EMBODIMENTS

Preferred embodiments of this invention will now be described.

Figure 1A:
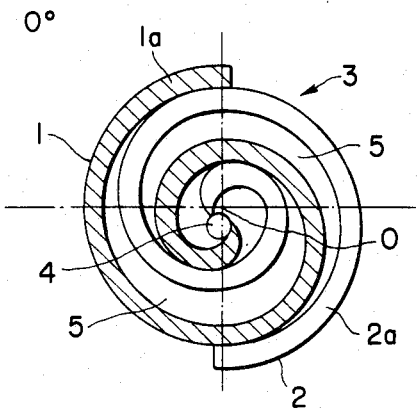
FIG. 1A PRIOR ART
FIGS. 1A through 1D are diagrams used for a description of the operating principles of a scroll compressor.
Figure 1D:
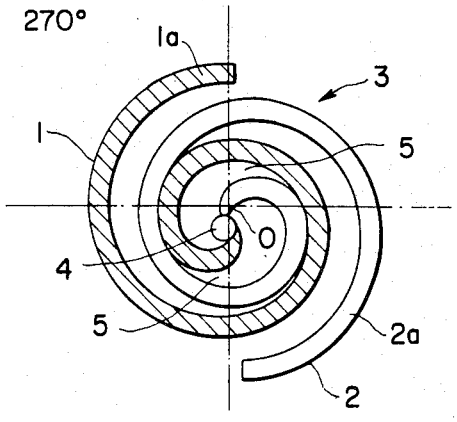
FIG. 1D PRIOR ART
Figure 1B:
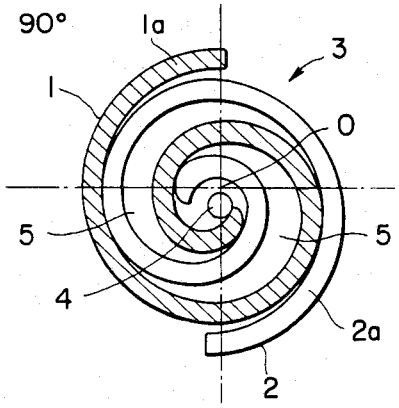
FIG. 1B PRIOR ART
Figure 1C:
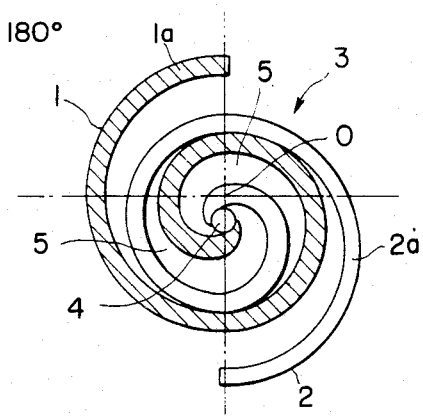
FIG. 1C PRIOR ART
Figure 2:
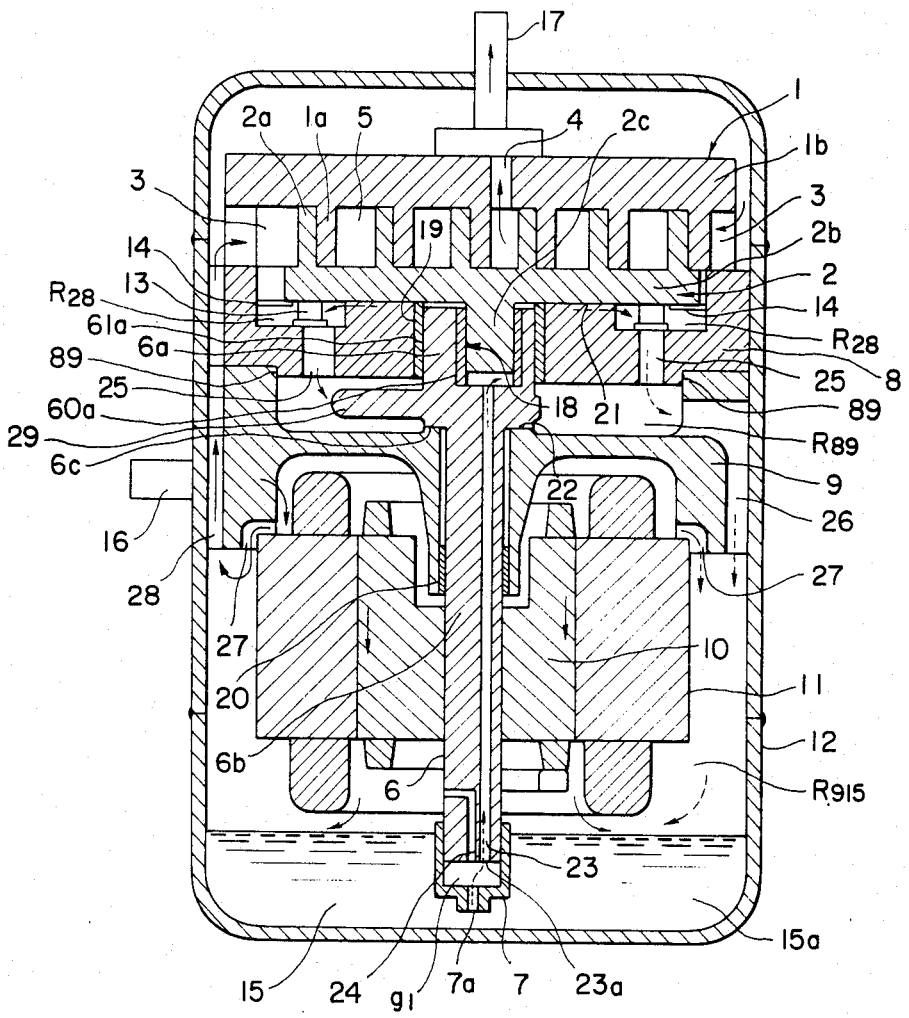
FIG. 2 is a sectional side view showing the overall arrangement of a closed scroll compressor to which the technical concept of the invention is applicable.

First, the construction and the operation of a scroll compressor to which the technical concept of the invention is applied will be described with reference to FIG. 2. FIG. 2 shows an example of a scroll compressor used as a totally enclosed refrigerant compressor. The constructions of essential components of the scroll compressor of FIG. 2 are illustrated in FIGS. 3 through 6.

In FIG. 2, reference numeral 1 designates a stationary scroll having a spiral wrap 1*a* on one side of a base plate 1*b;* 2, an orbiting scroll having a spiral wrap 2*a* on one side of a base plate 2*b* and a scroll shaft 2*c* on the other side; 3, gas refrigerant suction inlets (suction chambers); 4, a discharge port formed in the base plate 1*b* of the stationary scroll; 5, compression chambers formed between the wraps 1*a* and 2*a;* 6, a main shaft or a crankshaft; 7, an oil cap having a suction cap 7*a* and fitted on the lower end portion of the main shaft 6 with a predetermined gap $g_1$ between the oil cap and the lower end of the main shaft 6; 8 and 9, bearing frames disposed one on the other forming a chamber $R_{89}$ therebetween; 10, a motor rotor; 11, motor stator surrounding the motor rotor 10; 12, a closed housing; 13, an Oldhams coupling for preventing the rotation of the orbiting scroll; 14, a baffle board for preventing fluid flow between an Oldhams coupling accommodating chamber $R_{28}$, which is a chamber formed in the bearing frame 8 to accommodate the Oldhams coupling 13, and the suction chamber 3; 15, an oil pool provided on the bottom of the housing 12; 16, a suction pipe receiving gas refrigerant from the outlet of an evaporator (not shown); 17, a discharge pipe for the gas refrigerant compressed in the compression chambers; and 18, a metal bearing, which is eccentric with respect to the center of rotation of the main shaft 6 and rotatably mounted on the orbiting scroll shaft 2*c* to support the latter. The bearing 18 is fixedly inserted into an eccentric hole 60*a* formed in the upper end portion of the main shaft 6, namely, a large-diameter part 6*a,* positioned eccentric from the center of rotation of the main shaft 6, so that the central hole of the bearing 18 now defines the inner wall of the eccentric hole 60*a* so as to constitute a supporting surface of the eccentric hole 60*a.*

Further in FIG. 2, reference numeral 19 designates a first main metal bearing supporting the outer wall 61*a* of the large-diameter part 6*a* of the main shaft 6, surrounding the orbiting scroll bearing 18, and secured to the bearing frame 8; 20, a second main metal bearing which supports the lower end portion of the main shaft 6, namely, a small-diameter part 6*b,* the second main metal bearing 20 being fixedly secured to the bearing frame 9; 21, a first thrust bearing which supports the lower surface 20*b* of the base plate 2*b* of the orbiting scroll 2 from below in the axial direction, the first thrust bearing 21 being formed on the bearing frame 9, the second thrust bearing 22 supporting in the axial direction a step 6*c* between the large-diameter part 6*a* and the small-diameter part 6*b* of the main shaft 6; 23, a first lubricating hole formed in the main shaft 6 having an opening 23*a* at the lower end of the main shaft 6 and extending along an axis offset from the axis of rotation of the main shaft 6, the lubricating hole 23 communicating with the bearing gaps of the bearings 18 and 20 with small gaps between the supporting surfaces and the supported surfaces; 24, a gas relief hole formed in the main shaft 6; and 25 and 26, oil return holes for the oil path. The oil return holes 25 penetrate the bearing frame 8 vertically, thus communicating the Oldhams chamber $R_{28}$ with the chamber $R_{89}$. The oil return hole 26 is formed between the bearing frame 9 and the housing 12, thus communicating the space between the bearing frame 9 and the lubricant 15*a* in the oil pool, namely, a motor chamber $R_{915}$, with the above-described chamber $R_{89}$.

Further in FIG. 2, reference numerals 27 and 28 designate communication paths and communication holes for the suction gas path. The communication paths 27 are formed between the bearing frame 9 and the motor stator 11. The communication holes 28 are formed between the housing 12 and the bearing frames 8 and 9 in such a manner as to penetrate the bearing frames 8 and 9 vertically. The above-described suction inlets (suction chamber) 3 are communicated through the communication path 27 and the communication hole 28 with the suction pipe 16. Reference numeral 29 designates a balancer provided on the main shaft 6, the balancer 29 being accommodated in the chamber $R_{89}$.

With the orbiting scroll 2 engaged with the stationary scroll 1, the orbiting scroll shaft 2*c* is engaged through the orbiting scroll bearing 18 with the main shaft 6. The orbiting scroll 2 is supported by the orbiting scroll bearing 18 and the first thrust bearing 21 formed on the bearing frame 8. The main shaft 6 is supported by the first main bearing 19, the second main bearing 20 and the second thrust bearing 22, which are arranged in the bearing frames 8 and 9 which are combined together by a faucet coupling (89) or the like. The Oldhams coupling 13 is provided in the Oldhams chamber $R_{28}$ provided between the orbiting scroll 2 and the bearing frame 8 to prevent the rotation of the orbiting scroll 2, i.e., to allow only the orbiting revolution of the latter. The stationary scroll is fixedly secured to the bearing frames 8 and 9 with bolts. The motor rotor 10 and the motor stator 11 are fixedly coupled to the main shaft 6 and the bearing frame 9, respectively, by press-fitting, shrink-fitting, or with screws. The oil cap 7 is fixed to the main shaft 6 by press-fitting or shrink-fitting. The unit thus assembled is fixedly held in the housing 12 by press-fitting or shrink-fitting with the stationary and orbiting scrolls 1 and 2 at the top.

The operation of the scroll compressor thus constructed will now be described.

The rotation of the motor rotor 10 is transmitted through the main shaft 6 and the Oldhams coupling 13 to the orbiting scroll 2 to cause the latter to revolve, whereupon compression is carried out in accordance with the operating principles described with reference to FIGS. 1A through 1D. In this operation, the refrigerant gas is sucked into the housing 12 through the suction pipe 16 and passed through the communication paths 27 between the bearing frame 9 and the motor stator 11, and through the air gap between the motor rotor 10 and the motor stator 11, as indicated by solid line arrows, to cool the motor. Thereafter, the refrigerant gas is delivered through the communicating holes 28 between the housing 12 and the bearing frames 8 and 9 and the suction inlets 3 of the stationary scroll 1 into the compression chambers 5 where it is compressed. The gas thus compressed is discharged outside the compressor through the discharge port 4 and the discharge pipe 17.

The centrifugal pumping action of the oil cap 7 on the main shaft and the lubricating holes 23 formed in the main shaft 6 supplies lubricating oil from the oil pool 15 through the suction port 7*a* of the oil cap 7 and the lubricating hole 23 to the bearings 18 and 20, and from the bearing 18 to the bearings 21, 19 and 22, in the stated order, as indicated by the broken line arrows. The oil used for lubrication is returned to the oil pool 15 mainly through the oil return holes 25 and 26 formed in the bearing frames 8 and 9. In order to eliminate oil leaked from the bearing 21, etc., from being sucked directly into the suction inlets (suction chamber) 3, the baffle board 14 closes the gap between the bearing frame 8 and the outer wall of the orbiting scroll; that is, the suction inlets (suction chamber) 3 and the sliding mechanism are separated from each other by the baffle board 14 and the orbiting scroll 2. The gas relief hole 24 formed in the main shaft 6 causes the gas in the oil cap 7 to quickly flow out of the main shaft 6 during operation, thereby to improve the pumping efficiency.

Figure 3:
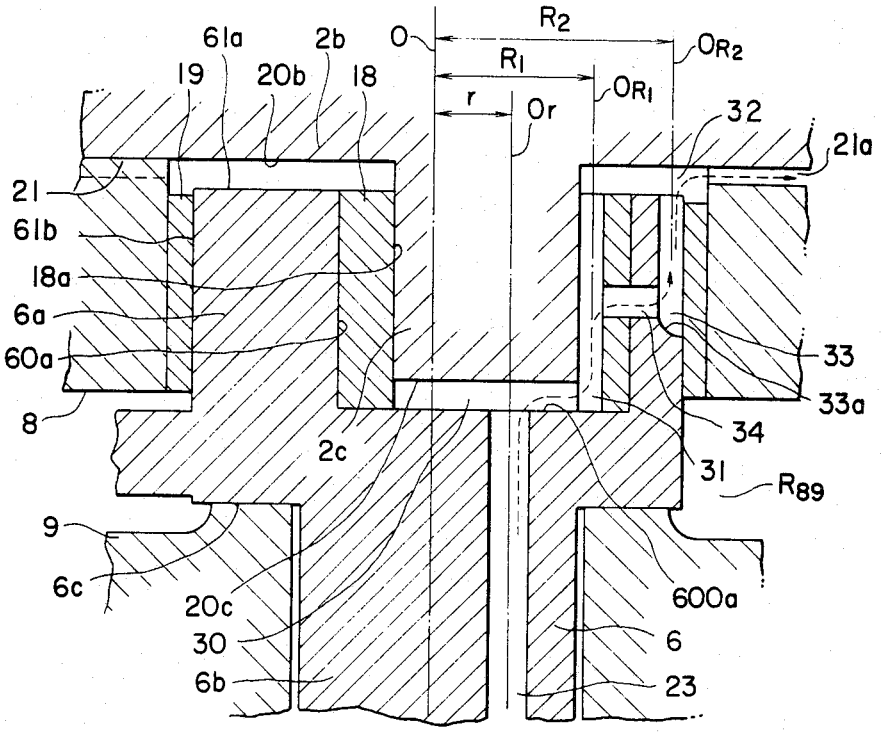
FIG. 3 is an enlarged sectional view showing essential components of a first example of a scroll compressor according to the invention.
Figure 4:
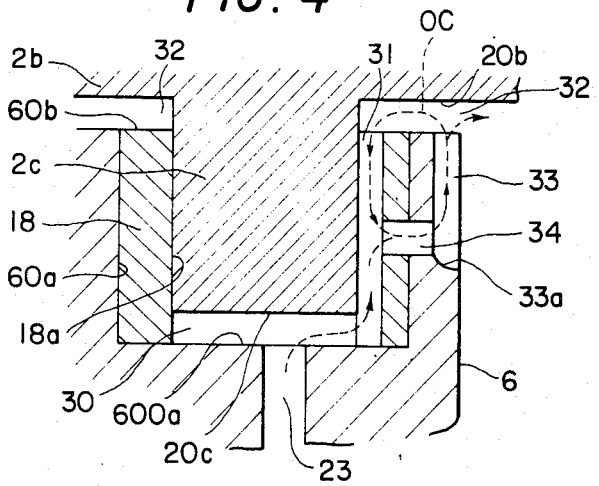
FIG. 4 is a side view for a description of the lubrication system in the scroll compressor in FIG. 3.

FIGS. 3 and 4 are enlarged detailed views showing essential parts of the scroll compressor in FIG. 2.

In FIG. 3, reference numeral 30 designates a first space which is defined by the lower end face 20*c* of the orbiting scroll shaft 2*c* of the orbiting scroll 2, the inner wall or supporting surface 18*a* of the orbiting scroll bearing 18, and the bottom 600*a* of an eccentric hole; and 31, a first lubricating groove formed in the inner wall 18*a* of the orbiting scroll bearing 18, penetrating the bearing 18 vertically from the lower end face to the upper end face. The lower end of the first lubricating groove 31 is communicated with the first space 30, and the upper end is communicated with a second space 32 defined by the upper end face 61*a* of the large diameter part 6*a* of the main shaft and the lower surface of the base plate 2*b* of the orbiting scroll 2.

Further in FIG. 3, reference numeral 33 designates a second lubricating groove formed in the outer wall of the large-diameter part 6*a* of the main shaft 6, extending vertically and confronting the inner wall of the main bearing 19, with the upper end communicated with the second space 32 and the lower end closed as indicated at 33*a;* and 34, a second lubricating hole formed at the middle of the orbiting scroll bearing 18 and communicating the first and second lubricating grooves 31 and 33. That is, the second lubricating hole 34 penetrates the metal bearing 18 and the large-diameter part 6*a* radially of the bearing 18 so that the first and second lubricating grooves 31 and 33 are communicated with each other through the second lubricating hole 34.

Further in FIG. 3, reference numeral 21*a* designates a plurality of groove-shaped oil paths which are formed, for instance, radially, in the upper surface of the thrust bearing 21, extending over the entire diametric length of the thrust bearing 21. The inner ends of the oil paths 21*a* are communicated with the first space 32, and the outer ends are communicated through the Oldhams chamber $R_{28}$ with the oil return holes 25. In FIG. 3, reference character O designates the center line around which the main shaft is rotated; $O_r$, the central axis of the first lubricating hole 23; and $O_{R1}$ and $O_{R2}$, the central axes of the first and second lubricating grooves 31 and 33, respectively.

The operation of the lubricating device thus constructed will be described with reference to FIGS. 2 and 3.

In the lubricating device as described above, pumping actions take place. More specifically, in the first lubricating hole 23, the first lubricating groove 31 and the second lubricating groove 33, pumping actions are effected by centrifugal forces of magnitudes determined by the distances from the central axis O, respectively; that is, the first lubricating hole 23, the first lubricating groove 31 and the second lubricating groove 33 operate as first, second and third pumps, respectively. The distances r, R1 and R2 from the central axis O are defined as to meet the following conditions:

$$r \leqq R1 < R2.$$

Therefore, the centrifugal force induced in the third pump, i.e., the second lubricating groove 33, is the largest. Accordingly, as the main shaft 6 rotates, the oil is caused to flow as indicated by the broken line in FIG. 2 or 3. More specifically, the oil flows through the first lubricating hole 23 into the first space, and then to the first lubricating groove 31. While flowing in the first lubricating groove 31, the oil is divided into two parts. A first of the two parts flows through the second lubricating hole 34 to the second lubricating groove 33, while a second part flows through the first lubricating groove 31, thus meeting the first part in the second space 32. The oil further flows through the oil paths 21*a* formed in the thrust bearing 21 and through the Oldhams chamber $R_{28}$ to the oil return holes 25.

If the above-described first lubricating groove 31 were not provided, the first and second spaces 30 and 32 would be communicated with each other only through the small gap between the outer wall of the orbiting scroll shaft 2*c* and the inner wall of the metal bearing 18 supporting the orbiting scroll shaft 2*c* radially—the small gap being considerably resistive against the flow of oil, and therefore the oil in the first space 30 could not sufficiently flow into the second space 32. Accordingly, the oil would not be sufficiently supplied to the small gap between the inner wall 60*a* of the large-diameter part 6*a* of the main shaft 6 and the outer wall of the main metal bearing 19 and to the small gap between the upper surface of the thrust bearing 21 and the lower surface of the base plate 2*b* of the scroll. Therefore, in such a case, the bearings 18, 19 and 21, and the surfaces of the orbiting scroll shaft 2*c*, the large-diameter part 6*a* of the main shaft and the orbiting scroll's base plate 2*b* which are supported by these bearings 18, 19 and 21 and confront the above-described small gaps would be abnormally worn, or the bearings 18, 19 and 21, and the orbiting scroll shaft 2*c*, the main shaft's large-diameter part 6*a*, and the orbiting scroll's base plate 2*b* possibly could seize.

On the other hand, provision of the first lubricating groove 31 allows the oil in the first space 30 to flow into the second space 32 readily, and therefore the above-described wear and seizure are substantially eliminated. Furthermore, due to the presence of the second lubricating hole 32 and the second lubricating groove 33, the oil in the first space 30 can more readily flow into the second space 32. Furthermore, because the closed end 33*a* of the second lubricating groove 33 is below the midpoint of the main metal bearing 19, as is apparent from FIG. 3, the inner wall of the main metal bearing 19 and the outer wall of the large-diameter part 6*a* are less worn than in the case where the closed end 33*a* is provided above the midpoint of the main metal bearing 19.

In tests conducted by the applicants on a scroll compressor as shown in FIGS. 2. and 3, it was found that oil circulates in a path OC consisting of the second lubricating groove 33, the second space 32, the first lubricating groove 31 and the second lubricating hole 34, as shown in FIG. 4. As described above, the third pump has a greater pumping capacity than the second pump; i.e., the distance R1 between the center O of rotation of the main shaft 6 and the first lubricating groove 31 is shorter than the distance R2 between the center O of rotation of the main shaft 6 and the second lubricating groove 33. Therefore, the centrifugal force acting on the second lubricating groove 33 is larger than that acting on the first lubricating groove 31, and accordingly the pressure in the second lubricating groove 33 is higher than that in the first lubricating groove 31. Thus, the oil tends to flow reversely from the second lubricating groove 33 through the second space 32 to the first lubricating groove 31. In addition, if the resistance of the thrust bearing 21 against the flow of oil in the third lubricating grooves 21*a* is high, a reverse flow of oil is liable to occur. The reverse flow of oil (OC) is advantageous in that dirty oil is scarecely pooled and heat is readily radiated when compared with the case where no first lubricating groove 31 is provided. However, it is desirable that fresh oil be sufficiently supplied into the first lubricating groove 31 without causing the reverse flow. The reverse flow of oil (OC) may be prevented by increasing the sectional area of each of the third lubricating grooves 21*a* or increasing the number of third lubricating grooves 21*a* thereby to decrease the pressure in the second space. However, these methods are not always acceptable because the area of the thrust surface of the bearing 21 to which the compressed gas pressure is applied from the base plate 2*b* of the orbiting scroll is decreased, i.e., the performance of the thrust bearing is lowered.

In view of the foregoing, the applicants have developed a technique for preventing the reverse flow of oil described above and supplying a sufficient quantity of oil to the first lubricating groove 31, as will be described with reference to FIG. 5.

Figure 5:
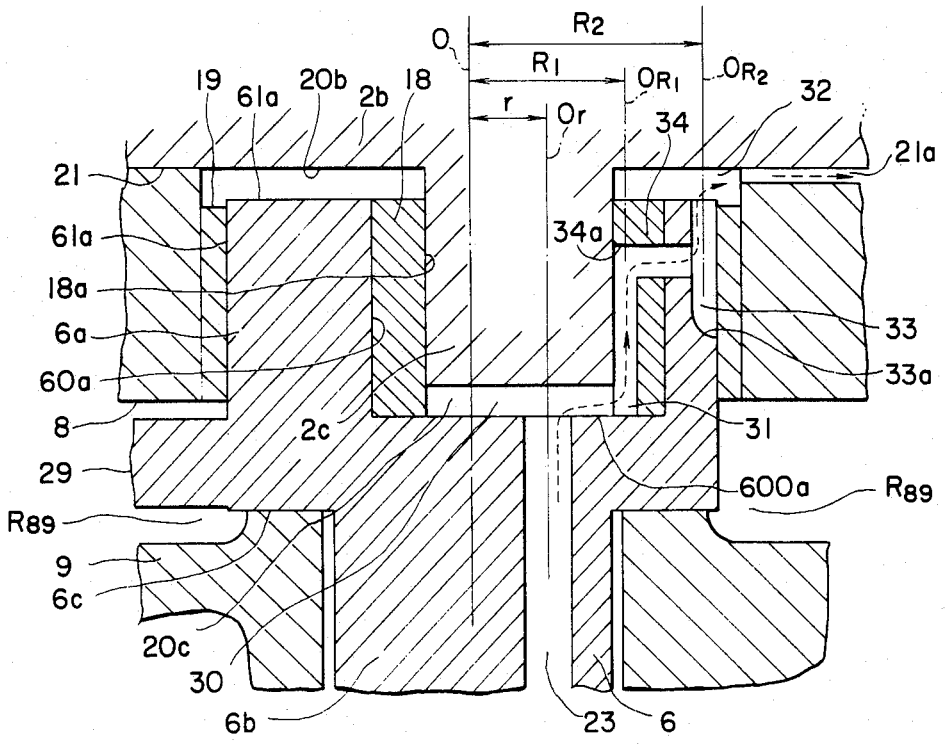
FIG. 5 is an enlarged sectional view showing essential components of a third example of the scroll compressor according to the invention.

As shown in FIG. 5, a first lubricating groove 31 is formed in the inner wall 18*a* of the orbiting scroll bearing 18 having a lower end communicated with the first space 30 and an upper end closed as indicated at 34*a*. It should be noted that, in order to supply a sufficient quantity of oil to the sliding surfaces of the orbiting scroll bearing 18 and the scroll shaft 2*c* at all times, the first lubricating groove 31 should extend vertically and linearly to near the upper surface of the orbiting scroll bearing 18 and communicate through the second lubricating hole 34 with the second lubricating groove 33, which also extends vertically and linearly. The second lubricating hole 34 and the closed end 34*a* of the first lubricating groove 31 are positioned above the middle of the bearing 18. The second lubricating groove 33 extends to near to the lower end of the main bearing 19 in order to sufficiently lubricate the sliding surfaces of the main shaft 6 and the main bearing 19. That is, the closed end 33*a* of the second lubricating groove 33 is positioned below the middle of the bearing 19. As a result, an oil path is formed by the first lubricating hole 23, the first space 30, the first lubricating groove 31, the second space and the third lubricating grooves 21*a*, as indicated by a broken line in FIG. 5. Oil is sufficiently supplied to the bearings through this path without causing the above-described reverse flow.

In the embodiment shown in FIG. 5, the flow rate of oil 15*a* from the oil pool 15 is increased compared with that in the embodiment shown in FIG. 3. In the embodiment shown in FIG. 3, the flow rate of the oil 15*a* depends on the distance $R_1$ between the axis O of rotation of the main shaft 6 and the first lubricating groove 31 because the upper end of the first lubricating groove 31 is communicated with the second space 32. On the other hand, in the embodiment shown in FIG. 5, the upper end of the first lubricating groove 31 is closed and only the upper end of the second lubricating groove 33 is substantially communicated with the second space 32. Therefore, in the embodiment shown in FIG. 5, the flow rate of the oil 15*a* depends only on the distance $R_2$ between the axis O of rotation of the main shaft 6 and the second lubricating groove 33. As described above, $R1<R2$. Accordingly, the flow rate of the oil 15*a* in the embodiment shown in FIG. 5 is greater than in the embodiment shown in FIG. 3, and the flow rate in the first lubricating hole 23 in the embodiment shown in FIG. 5 is larger than the flow rate in the first lubricating hole 23 in the embodiment shown in FIG. 3.

As described above, in the embodiment shown in FIG. 5, the flow rate in the first lubricating hole 23 is larger, and all of the oil passing through the first lubricating hole 23 is supplied to the first lubricating groove 31. Therefore, although the first lubricating groove 31 is shorter than that in the embodiment shown in FIG. 3, fresh oil is sufficiently supplied to the orbiting scroll bearing 18.

The reasons why a sufficient quantity of lubricant is supplied to the small gap (bearing gap) between the orbiting scroll shaft 2*c* and the orbiting scroll bearing 18 and above the closed end 34*a* of the first lubricating groove 34 (although the latter is terminated at the closed end 34*a*) are that the pressure in the first lubricating groove 31 is higher than that in the second space 32, and the distance between the closed end 34*a* and the second space 32 is short. Also, the axis of the first lubricating groove 31 crosses the direction of relative rotation of the orbiting scroll shaft 2*c* and the orbiting scroll bearing 18; in other words, the first lubricating groove 31 has first and second ends which are displaced with respect to one another along a direction parallel to the axis of rotation of the large-diameter part 6*a*, so that the flow of oil has a component in a direction parallel to the axis of rotation of the large-diameter part 6*a*.

Similarly, the reasons why a sufficient quantity of lubricant is supplied to the small gap (bearing gap) between the large-diameter part 6*a* of the main shaft 6 and the main bearing 18 and above the closed end 33*a* of the second lubricating groove 33 (although the latter terminates at the closed end 33*a*) are that the pressure near the closed end 33*a* of the second lubricating groove 33 is higher than that in the chamber $R_{89}$, and the vertical distance between the closed end 33*a* and the chamber $R_{89}$ is relatively short. Also, the axis of the second lubricating groove 33 crosses the direction of rotation of the large-diameter part 6*a;* in other words, the second lubricating groove has first and second ends which are displaced with respect to one another along a direction parallel to the axis of rotation of the large-diameter part 6*a*, so that the flow of oil has a component in a direction parallel to the axis of rotation of the large-diameter part 6*a*.

In the case where the speed of the scroll compressor is controlled by an inverter or the like, the distance r for the first pump should be determined so that a sufficiently high head can be obtained in the rated operation (using 50 or 60 Hz for instance) because, even if the speed of the scroll compressor is decreased and therefore the head of the first pump decreased, lubrication can still be stably supplied owing to the suction effect of the second and third pumps on the first pump.

Figure 6:
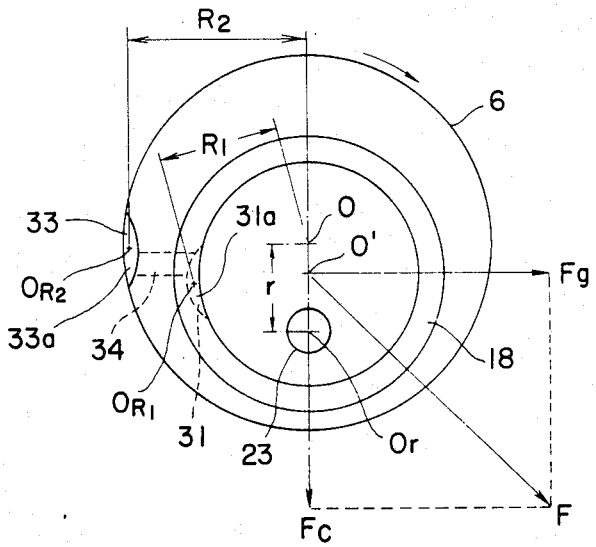
FIG. 6 is a slightly contracted plan view of a main shaft and an orbiting scroll bearing in the scroll compressor shown in FIG. 5.

In the embodiment shown in FIGS. 2 and 5, the first and second lubricating grooves 31 and 33 and the second lubricating hole 34 are provided on the side opposite the side where a load is applied to the main shaft 6 and the orbiting scroll bearing 18, as is apparent from FIG. 6. FIG. 6 is a slightly contracted view of essential components obtained by viewing the main shaft 6 from above. In FIG. 6, those components which have been previously described with reference to FIG. 5 are therefore designated by the same reference numerals or characters. Further in FIG. 6, reference character O′ designates the center of the orbiting bearing 18. The centrifugal force $F_c$ which acts on the orbiting scroll 2 during operation is applied along the line connecting the center O and the aforementined center O′; more specifically, the centrifugal force $F_c$, expressed in vector form, xtends from the point O′ as indicated by the arrow. On the other hand, the direction of a radial direction gas load $F_g$ is substantially perpendicular to that of the centrifugal force $F_c$; more specifically, the radial direction gas load $F_g$, expressed in vector form, extends from the point O′ as indicated by the arrow. The centrifugal force $F_c$ and the gas load $F_g$ are combined into a resultant force f. Therefore, by providing the first and second lubricating grooves 31 and 33 and the second lubricating hole 34 at other than the load region defined by the centrifugal force $F_c$, the gas load $F_g$, and the resultant force F, the sliding surfaces of the bearings can be sufficiently lubricated. This technical concept is equally applicable to the first embodiment described with reference to FIG. 3.

Figure 3A:
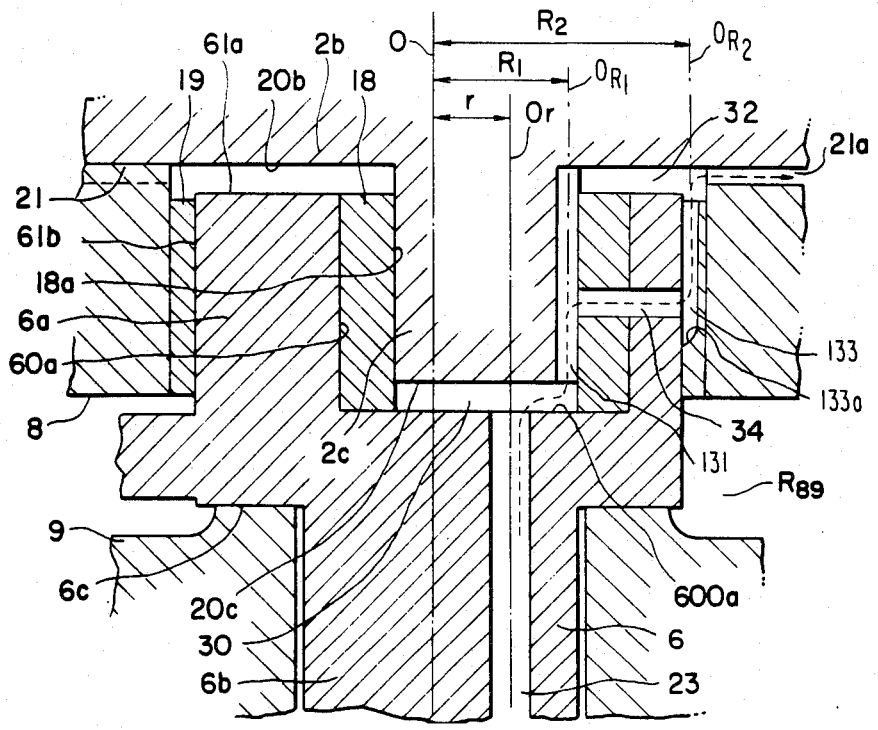
FIG. 3A is an enlarged sectional view showing essential components of a second example of a scroll compressor according to the invention.

The first lubricating groove 31 may be formed in the orbiting scroll shaft 2*c* and/or the supporting surface adapted to support the shaft 2*c*. The inner wall of the eccentric hole 60*a* supports an outer wall of the orbiting scroll shaft 2*c*, so that the first lubricating groove 31 is formed in a supporting surface of the eccentric hole, as shown in FIG. 3. The second lubricating groove 33 also may be formed in the outer wall 61*a* of the large-diameter part 6*a* of the main shaft 6 and/or the supporting surface of the main bearing 19. Thus, the first and second lubricating grooves 31 and 33 may alternatively be formed as shown in FIG. 3A, where the first lubricating groove 131 is formed in an outer wall of the orbiting scroll shaft 2*c*, and the second cooperating surface, so that the second lubricating groove 133 is formed in a supporting surface of the main bearing 19.

We claim:

1. A scroll compressor, comprising:

a closed housing having an oil pool at a bottom thereof;

a bearing frame provided in said housing;

a stationary scroll provided in said housing and positioned above said bearing frame, said stationary scroll having a first spiral wrap on the side of said bearing frame;

an orbiting scroll provided in said housing and interposed between said stationary scroll and said bearing frame and which has a second spiral wrap on the side of said stationary scroll, said first and second wraps being combined together to form refrigerant gas compression chambers therebetween;

a main shaft which penetrates said bearing frame vertically and is supported by said bearing frame, said main shaft having an upper end portion coupled to said orbiting scroll and a lower end portion immersed in lubricant in said oil pool;

an electric motor arranged between said bearing frame and oil pool to rotate said main shaft;

a rotation preventing mechanism for, when said motor applies torque to said orbiting scroll through said main shaft, preventing said orbiting scroll from rotating but allowing said orbiting scroll to resolve;

a first centrifugal pump for pumping lubricant substantially in the axial direction of said main shaft from said oil pool to an upper portion of said main shaft with the aid of centrifugal force produced by said main shaft and said main shaft rotates;

a second centrifugal pump, formed substantially in the axial direction of said main shaft, for supplying lubricant thus pumped from said first centrifugal pump to a sliding part between said main shaft and said orbiting scroll with the aid of centrifugal force produced by said shaft as said main shaft rotates; and a third centrifugal pump, formed substantially in the axial direction of said main shaft, for supplying lubricant discharged by said second centrifugal pump to a sliding part between said main shaft and said bearing frame with the aid of centrifugal force produced by said main shaft as said main shaft rotates.

2. The scroll compressor as claimed in claim 1, wherein said first, second and third centrifugal pumps are series connected to provide a series of lubricating paths.

3. The scroll compressor as claimed in either one of claims 1 and 2, wherein said second centrifugal pump is positioned radially outwardly of said first centrifugal pump, and said third centrifugal pump is positioned radially outwardly of said second centrifugal pump.

4. A scroll compressor, comprising:

a closed housing having an oil pool at a bottom thereof;

a bearing frame provided in said housing;

a stationary scroll provided in said housing and positioned above said bearing frame, said stationary scroll having a first spiral wrap on the side of said bearing frame;

an orbiting scroll provided in said housing and interposed between said stationary scroll and said bearing frame, said first and second wraps being combined together to form refrigerant gas compression chambers therebetween;

a main shaft which penetrates said bearing frame vertically and is supported by said bearing frame, said main shaft having an upper end portion coupled to said orbiting scroll and a lower end portion immersed in lubricant in said oil pool;

an electric motor arranged between said bearing frame and oil pool to rotate said main shaft;

a rotation preventing mechanism for, when said motor applies torque to said orbiting scroll through said main shaft, preventing said orbiting scroll from rotating but allowing said orbiting scroll to resolve;

a first centrifugal pump for pumping lubricant substantially in the axial direction of said main shaft from said oil pool to an upper portion of said main shaft with the aid of centrifugal force produced by said main shaft as said main shaft rotates;

a second centrifugal pump, formed substantially in the axial direction of said main shaft, for supplying lubricant thus pumped from said first centrifugal pump to a sliding part between said main shaft and said orbiting scroll with the aid of centrifugal force produced by said shaft as said main shaft rotates; and a third centrifugal pump, substantially in the axial direction of said main shaft, for supplying lubricant discharged by said second centrifugal pump to said rotation preventing mechanism through an oil path between said orbiting scroll and said bearing frame with the aid of centrifugal force produced by said main shaft as said main shaft rotates.

5. The scroll compressor as claimed in claim 4, wherein said first, second and third centrifugal pumps are series connected to provide a series of lubricating paths.

6. The scroll compressor as claimed in either one of claims 4 and 5, wherein said second centrifugal pump is positioned radially outwardly of said first centrifugal pump, and said third centrifugal pump is positioned radially outwardly of said second centrifugal pump.

7. A scroll compressor, comprising:

a first base plate;

an orbiting scroll having a first spiral wrap on one side of said first base plate and an orbiting scroll shaft on the other side of said first base plate;

a second base plate;

a stationary scroll having a second spiral wrap on one side of said second base plate, said first and second wraps being combined together to form compression chambers therebetween;

a main shaft for driving said orbiting scroll, said main shaft having a large-diameter part with an eccentric hole formed in an end face thereof, said eccentric hole having an inner wall for supporting an outer wall of said orbiting scroll shaft;

a main bearing supporting an outer wall of said large-diameter part, said main bearing having an inner supporting surface;

a bearing frame supporting said main bearing, said bearing frame being provided below said orbiting scroll and confronting said first base plate;

an electric motor for driving said main shaft; and a housing having an oil pool at a bottom thereof, said housing accommodating said orbiting scroll and said stationary scroll above said bearing frame and said motor below said bearing frame, a lower end portion of said main shaft being immersed in lubricant in said oil pool;

a first lubricating hole being formed in said main shaft, said first lubricating hole having one end opening in said oil pool and the other end communicating with a first space formed between a bottom of said eccentric hole and a lower end of said orbiting scroll shaft;

a first lubricating groove being formed in at least one of said outer wall of said orbiting scroll shaft and a supporting surface of said eccentric hole, said first lubricating groove extending vertically, said first lubricating groove having a lower end communicating with said first space;

a second lubricating groove being formed in at least one of said outer wall of said large-diameter part and said supporting surface of said main bearing, said second lubricating groove extending vertically, said second lubricating groove having an upper end communicating with a second space formed between an upper end face of said main bearing and a lower surface of said first base plate;

p1 a second lubricating hole penetrating said large-diameter part to communicate a part of said first lubricating groove located above said lower end of said first lubricating groove with a part of said second lubricating groove located below said upper end of said second lubricating groove;

an oil path communicating with said second space formed between said orbiting scroll and said bearing frame; and oil return paths extending vertically in said bearing frame, whereby lubricant from said oil pool is circulated serially through said first lubricating hole, said first space, said first lubricating groove, said second lubricating hole, said second lubricating groove, said oil path, and said oil return paths by centrifugal force produced by rotation of said main shaft.

8. The scroll compressor as claimed in claim 7, wherein:

said shaft includes an orbiting scroll bearing disposed in contact with said outer wall of said orbiting scroll shaft and defining said inner wall of said eccentric hole; and said first lubricating groove has an upper end, said lower and upper ends of said first lubricating groove being axially displaced from one another with respect to an axis of rotation of said large-diameter part of said main shaft, and said second lubricating groove has a lower end, said lower and upper ends of said second lubricating groove being axially displaced from one another with respect to an axis of rotation of said large-diameter part of said main shaft.

9. The scroll compressor as claimed in claim 7, wherein:

said main shaft includes an orbiting scroll bearing disposed in contact with said outer wall of said orbiting scroll shaft and defining said inner wall of said eccentric hole; and said second lubricating hole is positioned substantially at half a height of said orbiting scroll bearing.

10. The scroll compressor as claimed in claim 7, wherein said first and second lubricating grooves and said second lubricating hole are arranged in other than a load region defined by a centrifugal force which acts on said orbiting scroll during operation thereof, a gas load which acts on said orbiting scroll radially during operation thereof, and a resultant force of said centrifugal force and said gas load.

11. The scroll compressor as claimed in any one of claims 7, 9, 10 and 8, wherein said second lubricating groove has a lower end closed below said second lubricating hole.

12. The scroll compressor as claimed in any one of claims 7, 9, 10 and 8, wherein a plurality of oil paths are formed radially in a thrust bearing formed on an upper surface of said bearing frame, said oil paths being communicated with said second space.

13. The scroll compressor as claimed in claim 12, wherein a chamber for accommodating an Oldhams coupling is formed in said bearing frame located radially outwardly of said thrust bearing, lubricant passing through said oil paths formed in said thrust flowing through said chamber to oil return paths.

14. A scroll compressor, comprising:

a first base plate;

an orbiting scroll having a first spiral wrap on one side of said first base plate and an orbiting scroll shaft on the other side of said first base plate;

a second base plate;

a stationary scroll having a second spiral wrap on one side of said second base plate, said first and second wraps being combined together to form compression chambers therebetween;

a main shaft for driving said orbiting scroll, said main shaft having a large-diameter part with an eccentric hole formed in an end face thereof, said eccentric hole having an inner wall for supporting an outer wall of said orbiting scroll shaft;

a main bearing supporting an outer wall of said large-diameter part, said main bearing having an inner supporting surface;

a bearing frame supporting said main bearing, said bearing frame being provided below said orbiting scroll and confronting said first base plate of said orbiting scroll;

a thrust bearing provided on an upper end of the bearing frame to support said orbiting scroll;

an electric motor for driving said main shaft; and a housing having an oil pool at a bottom thereof, said housing accommodating said orbiting scroll and said stationary scroll above said bearing frame and said motor below said bearing frame, a lower end portion of said main shaft being immersed in lubricant in said oil pool;

a first lubricating hole having one end opening in said oil pool and the other end communicating with a first space formed between a bottom of said eccentric hole and a lower end of said orbiting scroll shaft;

a first lubricating groove being formed in at least one of said outer wall of said orbiting scroll shaft and a supporting surface of said eccentric hole, said first lubricating groove extending vertically, said first lubricating groove having a lower end communicating with said first space and an upper end close to an upper end of said eccentric hole;

a second lubricating groove formed in at least one of said outer wall of said large-diameter part and said supporting surface of said main bearing, said second lubricating groove extending vertically, said second lubricating groove having a lower end close to a lower end of said main bearing and an upper end communicating with a second space formed between an upper end face of said main bearing and a lower surface of said first base plate;

a second lubricating hole penetrating said large-diameter part to communicate a part of said first lubricating groove located above said lower end of said first lubricating groove with a part of said second lubricating groove located below said upper end of said second lubricating groove;

a third lubricating groove being formed radially in a bearing surface of said thrust bearing, said third lubricating groove having an inner end communicating with said second space; and oil return paths extending vertically in said bearing frame, whereby lubricant from said oil pool is serially circulated through said first lubricating hole, said first space, said first lubricating groove, said second lubricating hole, said second lubricating groove, said third lubricating groove, and said oil return paths by centrifugal force produced by rotation of said main shaft.

15. The scroll compressor as claimed in claim 8, wherein:

said shaft includes an orbiting scroll bearing disposed in contact with said outer wall of said orbiting scroll shaft and defining said inner wall of said eccentric hole; and said first lubricating groove has an upper end, said lower and upper ends being axially displaced from one another with respect to an axis of rotation of said large-diameter part of said main shaft, and said second lubricating groove has a lower end, said lower and upper ends being axially displaced from one another with respect to an axis of rotation of said large-diameter part of said main shaft.

16. The scroll compressor as claimed in claim 14, wherein:

said main shaft includes an orbiting scroll bearing disposed in contact with said outer wall of said orbiting scroll shaft and defining said inner wall of said eccentric hole; and a position of said second lubricating hole is above a middle point of said orbiting scroll bearing in a vertical direction.

17. The scroll compressor as claimed in claim 14, wherein said first and second lubricating grooves and said second lubricating hole are arranged in other than a load region defined by a centrifugal force which acts on said orbiting scroll during operation thereof, a gas load which acts on said orbiting scroll radially during operation thereof, and a resultant force of said centrifugal force and said gas load.

18. The scroll compressor as claimed in any one of claims 14, 10, 11 and 15 wherein a chamber for accommodating an Oldhams coupling is formed in said bearing frame located radially outwardly of said thrust bearing, lubricant passing through said oil paths formed in said thrust bearing flowing through said chamber to oil return paths.

* * * * *